US006378937B1

(12) United States Patent
Faudman

(10) Patent No.: US 6,378,937 B1
(45) Date of Patent: Apr. 30, 2002

(54) RETRACTABLE INFANT-SEAT SHOULDER STRAP

(76) Inventor: David Allen Faudman, 23 Highland Ct., Larkspur, CA (US) 94939

( * ) Notice: Subject to any disclaimer, the term of this patent is extended or adjusted under 35 U.S.C. 154(b) by 0 days.

(21) Appl. No.: 09/499,806

(22) Filed: Feb. 8, 2000

(51) Int. Cl.[7] ..... A47C 31/00; A47C 1/08

(52) U.S. Cl. ..... 297/183.1; 297/183.2; 297/183.6; 297/250.1; 297/277

(58) Field of Search ..... 297/183.1, 183.2, 297/183.6, 251.1, 277

(56) References Cited

U.S. PATENT DOCUMENTS 2,689,672 A * 9/1954 Thompson ..... 224/6
3,269,621 A * 8/1966 Dishart ..... 224/6
4,389,005 A * 6/1983 Cable et al. ..... 224/159
4,979,833 A * 12/1990 Cook ..... 383/12
4,982,997 A * 1/1991 Knoedler et al. ..... 297/296
5,540,365 A * 7/1996 LaMair ..... 224/158
D400,703 S * 11/1998 Cabagnero ..... D3/213
5,829,835 A * 11/1998 Rogers et al. ..... 297/256.17
5,897,039 A * 4/1999 Swenke ..... 224/162
6,053,381 A * 4/2000 Fahl et al. ..... 224/153
6,070,702 A * 6/2000 Der Kinderen ..... 190/109

* cited by examiner

*Primary Examiner*—Peter R. Brown
*Assistant Examiner*—Joseph Edell
(74) *Attorney, Agent, or Firm*—Risto A. Rinne, Jr.

(57) ABSTRACT

An apparatus for the assisted portage of automobile types of infant-seats separate from an automobile includes a coiled holder with an extensible strap that is attached to one side of the infant-seat and a screw-eye that is attached to the other side. The extensible strap includes a first end with a fastening device such as a spring clip that is attached to the screw-eye when the strap is extended out of the coiled holder and over the shoulder of a user. The extensible strap is set to any desired length and is locked at that position by the coiled holder or it is automatically retracted therein depending upon the position of a locking toggle on the coiled holder. Preferably, the coiled holder is attached to one side of a handle of the infant-seat at a pivot axis for the handle and the screw-eye is attached to the opposite side. The pivot axis is disposed proximate the center of gravity and therefore optimally supports the infant-seat. When it is draped over the shoulder and locked in position, the extensible strap is used as a shoulder strap to assist in supporting some of the weight of the infant-seat.

17 Claims, 3 Drawing Sheets

RETRACTABLE INFANT-SEAT SHOULDER STRAP

BACKGROUND OF THE INVENTION

1. Field of the Invention

The present invention, in general relates to automobile infant-seats and, more particularly, to devices that provide assistance when carrying an infant-seat.

Regulations require that infants, when placed in an automobile, be secured in an approved type of a car seat, also known as an infant-seat.

Infant-seats are well known types of devices that are secured to the automobile by the restraint system (i.e., the seat belt) of the automobile and which, in turn, secure the infant thereto, thus protecting the infant in the event of an impact or a sudden stop.

Because the design of infant-seats are regulated, they must contain certain features and therefore, share close similarities. For example, all common types of infant-seats include a pivotal carrying handle that pivots about an axis that is located approximately at the center of gravity axis of the infant-seat.

The location chosen for placement of the handle is intentional. When the handle is pivoted upward and is used to support both the infant-seat and an infant placed therein, the seat is then held in the normal (i.e., level) position. Obviously, it would be undesirable for the handle to support the infant-seat in such a manner so as to tilt the infant-seat and increases the risk that the infant might fall out of it.

Parents or caregivers then routinely carry the infant-seat by the handle along with the infant therein to stores, shops, and the like. Needless to say, the weight of carrying both the infant and the infant-seat wears upon the person over time.

Furthermore, the handle can tend to apply all of the weight of both the infant and the seat to a relatively small area of the arm, for example, of the person that is supporting them. The pressure is greater than if the infant were carried by him or herself in which case the weight would be distributed over a greater area of contact. The area of contact by the handle tends to create a pressure point.

If the person carrying the infant and the infant-seat by the handle becomes fatigued there is at best some discomfort for the person having to carry the infant-seat and at worst there is risk of dropping the seat and of harming the infant who is disposed in it.

Awareness of the underlying discomfort of carrying the infant and infant-seat in that manner can manifest itself as a tendency to leave the infant in the infant-seat resting upon a surface while the parent or caregiver runs a "quick" errand. The absence of proximal care by the parent or caregiver increases the risk of an abduction or other possible form of abuse occurring to the infant.

Though the known prior art shows little or no recognition of the aforementioned problems, the use of a shoulder strap, for example, to directly support an infant (not an infant-seat) is known though not to support an infant-seat itself. The variations that do exist from manufacturer to manufacturer of infant-seats produced have precluded discovery of a solution heretofore.

Also, as there are many infant-seats already in use, it would indeed be desirable to provide a solution to the problem of safely and comfortably transporting an infant-seat that can both be utilized with new products being sold or developed and also retrofitted to work with existing infant-seats that have already been sold and are now in use.

Another impediment that has prevented solution thus far relates to increasing the weight or bulk of current infant-seats. Any type of an assist, if added to the infant-seat, can potentially increase either the weight or size (bulk) of the infant-seat. Neither type of an increase is desirable.

A further obstacle tending to preclude a solution is that any type of an assist to aid in carrying the infant-seat, if added to the seat, then becomes an added encumbrance when it is not in use. Any type of assist, such as a strap, can snag on an object, for example, when the person carrying the infant-seat passes by the object if the assist is not actively being used. This is a real possibility if the person carrying the infant-seat is only going to traverse a short distance and does not feel that he or she needs an assist. A strap, for example, if not used would then dangle from the infant-seat if not used.

If this were to occur, there is risk that the forward motion of the infant-seat (and infant) would be stopped abruptly, thereby possibly dislodging the infant-seat from the person and causing it to fall.

Furthermore, additional straps and the like, if used, pose a health hazard to the infant when they are not in use. There is risk that the infant can become ensnared in any such type of an accessory and that it could, for example, become wrapped around the infant's neck, thereby creating a choking hazard.

Another difficulty is that parents and caregivers are of different physical sizes and have different preferences as to the ideal position for carrying an infant-seat. Some would prefer to carry the infant-seat high on their person while others would prefer that it be carried low about or even below their waist. Therefore, an ideal assist would also have to be adjustable.

Compounding the requirement of an assist being adjustable, a mother might carry the infant-seat and then hand it over to a father to carry who would then have to readjust any possible type of an assist to suit his needs and preferences. Therefore, the assist device should be readily adjustable to accommodate such changing requirements.

As such, a solution to the problem of providing an assist to carry an infant-seat has proven itself to be elusive.

Accordingly, there exists today a need for a retractable infant-seat shoulder strap that provides an assist to a person carrying the infant-seat that does not provide a significant increase in weight or bulk, nor substantially increase the risk of it becoming an encumbrance or a hazard to the well being of the infant when it is not in use.

Clearly, such an apparatus would be a useful and desirable device.

2. Description of Prior Art

Infant carriers and accessories are, in general, known. For example, the following patents describe various types of these devices:

U.S. Pat. No. 2,689,672 to Thompson, Sep. 21, 1954;

U.S. Pat. No. 2,804,249 to Manalo, Aug. 27, 1957;

U.S. Pat. No. 4,234,229 to Arnold, Nov. 18, 1980;

U.S. Pat. No. 4,487,346 to Fischer, Jr., Dec. 11, 1984;

U.S. Pat. No. 5,011,057 to Perruzza et al., Apr. 30, 1991;

U.S. Pat. No. 5,020,709 to Hoaglan, Jun. 4, 1991;

U.S. Pat. No. 5,267,680 to Torok, Dec. 7, 1993;

U.S. Pat. No. 5,490,620 to Bergqvist, Feb. 13, 1996;

U.S. Pat. No. 5,522,528 to Petricola, Jun. 4, 1996;

U.S. Pat. No. 5,540,365 to LaMair, Jul. 30, 1996;

U.S. Pat. No. 5,573,156 to McConnell, Nov. 12, 1996;

U.S. Pat. No. 5,732,861 to Jakobson, Mar. 31, 1998; and

U.S. Pat. No. 5,813,580 to Fair, Sep. 29, 1998.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a retractable infant-seat shoulder strap that is easy to use.

It is also an important object of the invention to provide a retractable infant-seat shoulder strap that can be used with newly manufactured infant-seats.

Another object of the invention is to provide a retractable infant-seat shoulder strap that can be retrofitted to already manufactured infant-seats.

Still another object of the invention is to provide a retractable infant-seat shoulder strap that does not substantially increase the weight or bulk or the infant-seat.

Still yet another object of the invention is to provide a retractable infant-seat shoulder strap that does not provide a hazard when not in use.

Yet another important object of the invention is to provide a retractable infant-seat shoulder strap that includes a shoulder strap that can retract when not in use.

Still yet another important object of the invention is to provide a retractable infant-seat shoulder strap that includes a shoulder strap that can be secured (i.e., locked) in place at a desired length when it is in use.

Still one other object of the invention is to provide a retractable infant-seat shoulder strap that is readily adjustable.

Still one other important object of the invention is to provide a retractable infant-seat shoulder strap that can fit a wide variety of infant-seats with minimal modification.

Briefly, a retractable infant-seat shoulder strap for use with automobile types of infant-seats that is constructed in accordance with the principles of the present invention has a coiled holder with an extensible strap attached thereto to one side of the infant-seat. The extensible strap includes a first end with a fastening device such as a spring clip that is attached thereto. The first end can be extended from the coiled holder and the extensible strap can be set to any desired length and locked at that position by the coiled holder for as long as desired. The fastening device (i.e., the spring clip) is attached to a mating member such as a screw-eye that is disposed on a side of the infant-seat opposite that of the coiled holder. The extensible strap is then used as a shoulder strap to assist in supporting the infant-seat.

DETAILED DESCRIPTION OF THE INVENTION

Figure 1:
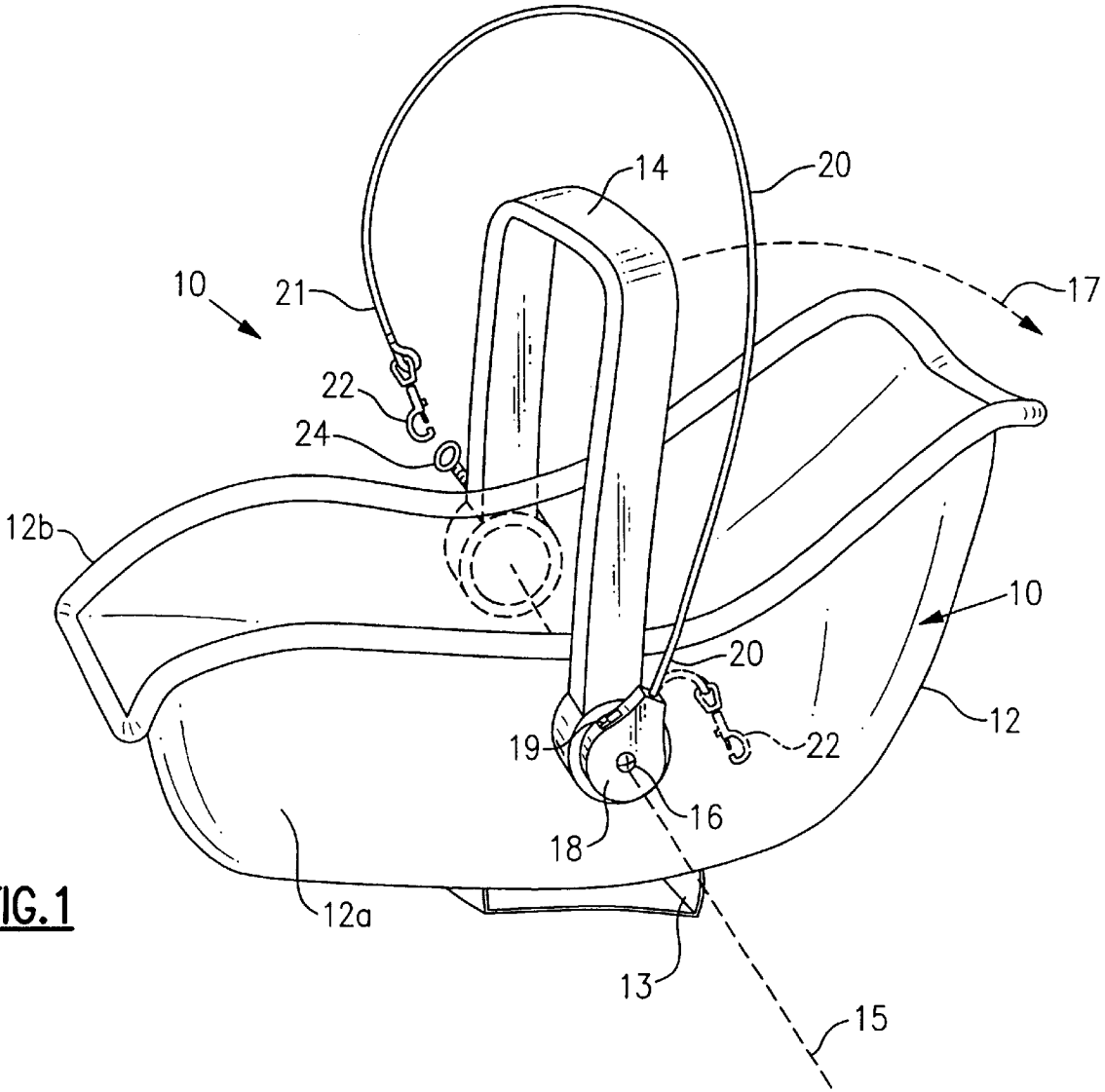
FIG. 1 is a view in perspective of a retractable infant-seat shoulder strap attached to an infant-seat.

Referring to all of the FIGURE drawings on occasion and in particular to FIG. 1 is shown, a retractable infant-seat shoulder strap, identified in general by the reference numeral 10, that is attached to an infant-seat 12. The retractable infant-seat shoulder strap 10 is shown with a strap 20 portion in an extended position and it is also shown in dashed lines with the strap 20 in a retracted position proximate a coiled holder 18.

The infant-seat 12 is a representative model of the type as is commonly sold by a variety of manufacturers and is designed for use with an automobile (not shown) to provide safety and support for an infant (not shown) during transportation in the automobile and also while away from the automobile.

Figure 3:
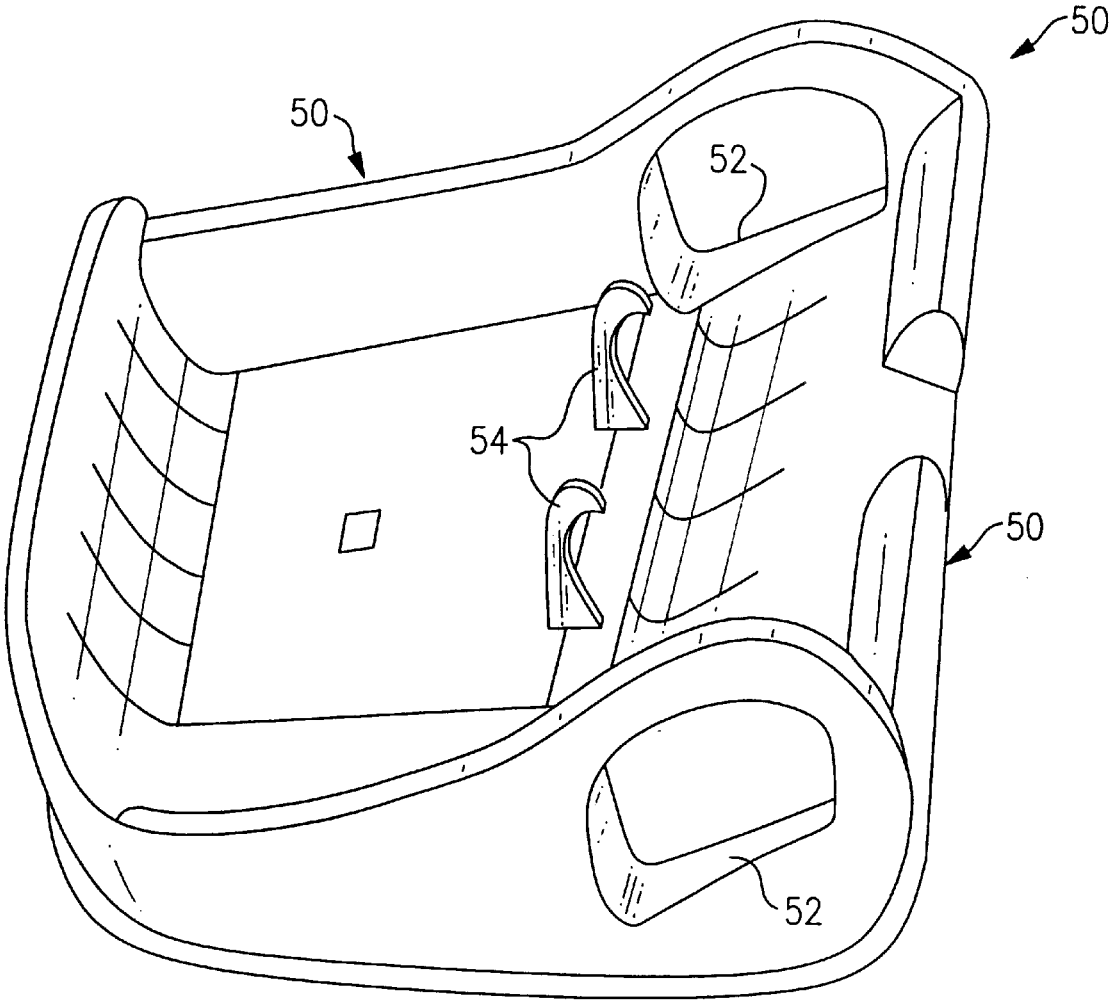
FIG. 3 is a view in perspective of a base portion of a typical infant-seat that is fastened to an automobile seat.

The infant-seat 12 includes an attachment area 13 for attachment to a base assembly (identified by reference numeral 50, FIG. 3). The attachment area 13 is included as a part of the infant-seat 12 and may not always appear as an extension from the bottom of each version of the infant-seat 12.

A handle 14 is pivotally attached at each side of the infant-seat 12 and is pivotal about an axis 15 (indicated by a dashed line). The axis 15 is generally located close to the center of gravity of the infant-seat 12, especially so when the infant is disposed therein.

The handle 14 is shown in the normal upright carrying position that is useful for transport of the infant-seat 12 and the infant away from the automobile. The handle 14 is able to pivot in one direction or the other or both, depending upon the manufacturer, about the axis 15 so as to be better stowed when the infant-seat 12 is attached and used with the automobile.

If the handle 14 is fully pivoted in a first generally upward direction, as shown by dashed curved arrow that is identified by reference numeral 17, it does not interfere with access to the interior portions of the infant-seat 12.

A pair of prior art screws (not shown) normally secure the handle 14 to the infant-seat 12 on each side thereof. The pair of prior art screws support the handle 14 and create the axis 15 about which the handle 14 may pivot. The prior art screws vary from manufacturer to manufacturer in terms of their size and thread pitch but in general, they all support the handle 14 that pivots about them.

The pair of prior art screws are removed to retrofit the retractable infant-seat shoulder strap to already existing infant-seats 12. The pair of prior art screws are omitted when the retractable infant-seat shoulder strap 10 is included with a newly manufactured infant-seats 12 and are replaced as is described in greater detail hereinafter.

A replacement screw 16 is used to secure the coiled holder 18 to a pivot point about the axis 15 on a first side 12*a* of the infant seat 12. The replacement screw 16 passes through the center of the coiled holder 18 where it anchors the retractable infant-seat shoulder strap 10 against the handle 14 and where it also secures the handle 14 and, therefore, also the retractable infant-seat shoulder strap 10, to the infant-seat 12 so that both are able to simultaneously pivot about the axis 15.

The coiled holder 18 includes the extensible strap 20 that is coiled therein about a spool (not shown). The strap 20 can be extended to any desired length and secured in that position by moving a locking toggle 19 from a "free" position into a "locked" position.

When the locking toggle 19 is in the free position the strap 20 can be extended or retracted back into the coiled holder 18. The coiled holder 18 includes an internal spring (not shown) that tends to rewind the strap 20 automatically when the locking toggle 19 is in the free position. The internal spring is not able to rewind the strap 20 when the locking toggle 19 is in the locked position.

When the locking toggle 19 is in the locked position the strap 20 is secured either fully retracted within the coiled holder 18 or it is secured in any extended position that is desired.

The locking toggle 19 is a mechanical device that is urged into either the free or locked position manually. In the locked position, the locking toggle 19 either pinches the strap 20 thereby securing the strap 20 in position or the locking toggle 19 provides a mechanical stop that prevents the spool, around which the strap 20 is wound, from rotating.

The coiled holder 18 is similar to a product that is currently marketed for use by dog and other pet owners as a leash. It is referred to as a "retractable belt leash".

Preferably, the coiled holder 18 is modified so as to include a wider configuration for the strap 20 than that of the retractable belt leash. If the strap 20 is wider, this facilitates better weight distribution of the infant-seat 12 about a shoulder (not shown) of a user (not shown), the use of which is described in greater hereinafter.

The strap 20 includes a first end 21 that extends from the coiled holder 18. The first end 21 is attached to a spring clip 22.

The spring clip 22 is a common type of a device that is well known and is used, for example, by pet owners as well as by others for detachably attaching one object to another, such as for detachably attaching a leash (not shown) to a collar (not shown) of a dog. Of course, there are many variations of devices commercially available that function similar to that of the spring clip 22 and can therefore be substituted in its place.

A screw-eye 24 is attached to the center of the handle 14 on a second side 12*b* of the infant seat 12. The screw-eye 24 replaces the screw that normally secures the handle 14 in position. The screw-eye 24, in addition to attaching the handle 14 to the infant seat 12, functions as a pivot for the handle 14 about the axis 15 on the second side 12*b* of the infant seat 12. The screw-eye 24 on the second side 12 and the replacement screw 16 on the first side 12*a* define the axis 15 about which the handle 14 pivots.

Figure 2:
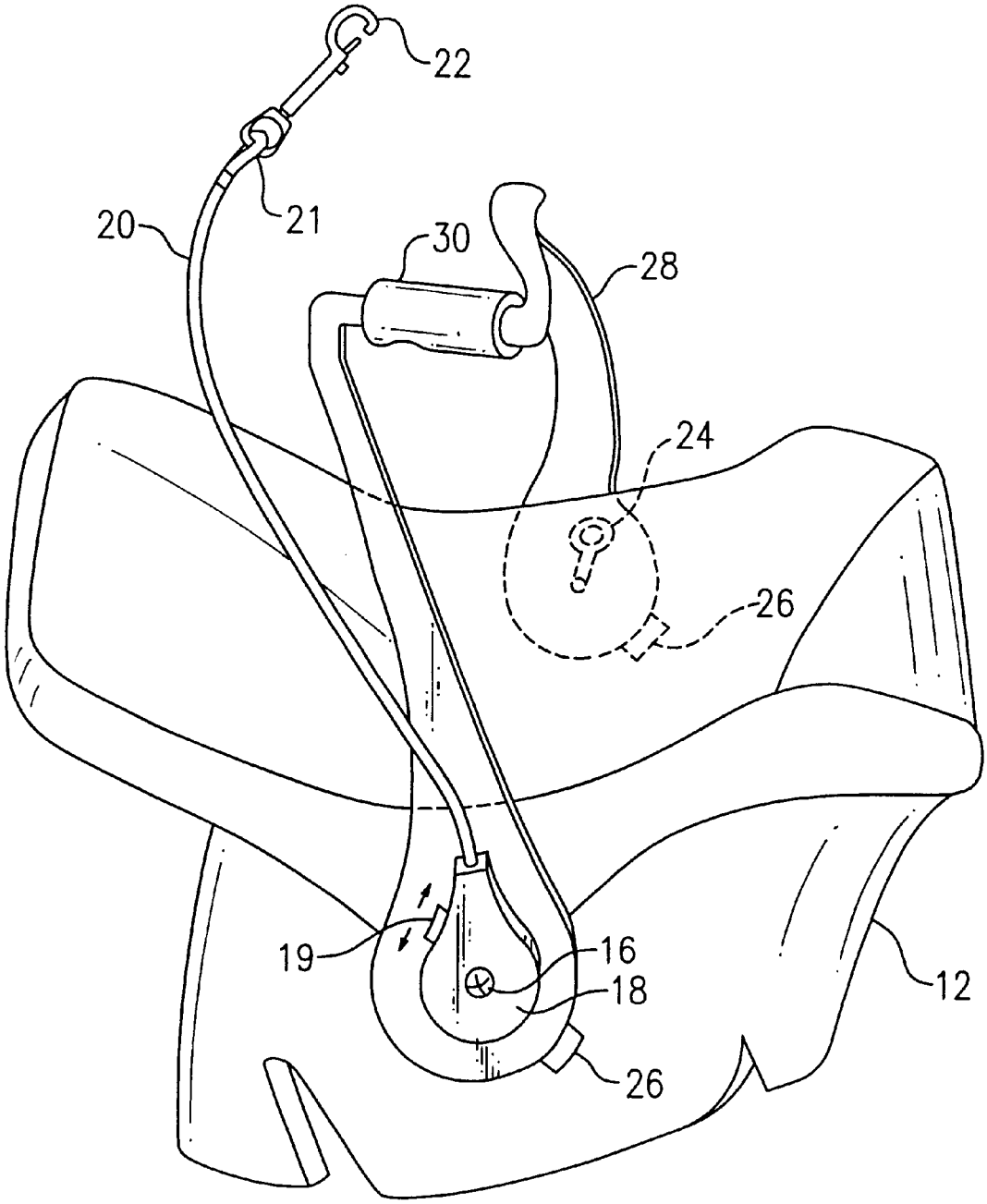
FIG. 2 is a view in perspective of a retractable infant-seat shoulder strap attached to an opposite side of a modified type of an infant-seat and also providing additional detail of a coiled holder of the retractable infant-seat shoulder strap.

Referring in particular to FIG. 2, a pair of handle release buttons 26 must be simultaneously depressed and held in order to be able to pivot the handle 14 or a modified handle 28 (FIG. 2).

The modified handle 28 illustrates how manufacturers are able to change certain attributes of the infant-seat 12 but that overall, it must still function in a similar manner as prescribed by various regulations. The modified handle 28 provides a hand grip 30 that is offset and offers, perhaps, somewhat easier portage. Even so, it does nothing to alleviate the weight of the infant-seat 12 and the infant that is placed therein.

The infant-seat 12 of FIG. 2 is designed to cooperate with the base assembly 50 (FIG. 3) so as to secure it in position. This is well known in the art and a detailed description is not needed for an understanding of the instant invention.

When the infant-seat 12 is not being used for portage of the infant, it is normally attached to the base assembly 50 in the automobile. The base assembly 50, as shown, is a representative example. It includes a pair of openings 52 through which a seat belt (not shown) is used to secure the base assembly 50 to the seat of the automobile. A catch mechanism 54 secures the infant-seat 12 to the base assembly 50.

Normally, the infant-seat is placed so that the infant therein faces rearward in the automobile and is therefore, better protected in the event of a frontal collision.

Referring alternately from FIG. 1 to FIG. 2 it is noted that the coiled holder 18 is disposed on opposite sides of the infant-seat 12. The user is able to install or to reverse the location of the coiled holder 18 and the screw eye 24 as desired because of symmetry in the design as to how the handle 14 is attached on both the first and second sides 12*a*, 12*b*. The ability to interchange position of the coiled holder 18 and the screw-eye 24 allows for their positioning so as to favor operation by either a right or a left handed user. Operation of the retractable infant-seat shoulder strap is described in greater detail hereinbelow.

Operation

The infant-seat 12 is detached from the base assembly 50. An infant is assumed to be in the infant-seat 12. The user moves, if need be, the locking toggle 19 into the free position and pulls the strap 20 out of the coiled holder 18 to a desired degree.

The user will typically extend the strap 20 over his or her shoulder first and then attach the spring clip 22 to the screw-eye 24. The infant-seat 12 is positioned where desired with respect to the user. For example, some users may like the infant-seat 12 to hang high up their waist whereas others may like it supported in a lower position.

In either case, the strap 20 is able to extend from the coiled holder 18 and to automatically retract therein until the perfect position is obtained. The entire weight of the infant-seat 12 is normally carried by the handle 14 during this adjustment period. Once the perfect position is obtained, the locking toggle 19 is moved into the locked position thereby securing the strap 20 in that position.

At this time the strap 20 can now be relied upon to bear some of the weight of the infant-seat 12. To that extent, the operator can reduce the force that he or she is exerting upon the handle 14. This naturally causes a portion of the weight to transfer to the strap 20 and shoulder of the user.

While it is theoretically possible for the shoulder of the user to bear all of the weight of the infant-seat 12, it is not wise for the user to entirely let go of the handle 14. As the infant-seat 12 contains an infant whose safety hinges upon his safe portage, total reliance upon the retractable infant-seat shoulder strap 10 is never recommended. A fail-safe system is provided when the user holds onto the handle 14 as well.

The length, size, and thread pitch of the replacement screw 16 and the screw eye 24 are varied to match the requirements of the infant-seat 12 and will change from manufacturer to manufacturer.

To retrofit the retractable infant-seat shoulder strap 10 to existing infant-seats 12 that have already been sold, the pair of prior art screws are removed and the coiled holder 21 is added to one side where it and the handle 14 are pivotally held in place by the replacement screw 16. The screw-eye 24 is added to the remaining side. The owner can easily accomplish this task.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A retractable infant-seat shoulder strap for use with an infant-seat, comprising:

(a) a strap having a first end and a second end;

(b) means for retaining said second end of said strap, said means for retaining said strap adapted to be disposed on one side of said infant-seat and attached thereto along an axis, said axis passing through each end of a handle, said handle adapted for use with said infant-seat and for pivoting about said axis;

(c) means for attaching said first end of said strap to a side of said infant-seat opposite said one side that is disposed said axis; and (d) means for adjusting the length of said strap.

2. The retractable infant-seat shoulder strap of claim 1 wherein said means for retaining said strap includes a spool adapted for winding said strap thereon.

3. The retractable infant-seat shoulder strap of claim 1 wherein said means for retaining said strap includes a coiled holder.

4. The retractable infant-seat shoulder strap of claim 3 wherein said coiled holder includes means for retracting said strap therein.

5. The retractable infant-seat shoulder strap of claim 1 wherein said means for attaching said strap includes means for detachably-attaching said first end of said strap.

6. The retractable infant-seat shoulder strap of claim 5 wherein said means for detachably-attaching said first end of said strap includes a spring clip attached to said first end of said strap.

7. The retractable infant-seat shoulder strap of claim 6 including a screw-eye attached to said side of said infant-seat opposite said one side and wherein said spring clip is adapted for detachable attachment thereto.

8. The retractable infant-seat shoulder strap of claim 1 wherein said means for adjusting the length of said strap includes means for extending said strap.

9. The retractable infant-seat shoulder strap of claim 1 wherein said means for adjusting the length of said strap includes a coiled holder said coiled holder adapted to extend said strap and adapted to retract said strap.

10. The retractable infant-seat shoulder strap of claim 9 wherein said means for adjusting the length of said strap includes means for maintaining said strap at a predetermined position of extension with respect to said coiled holder.

11. The retractable infant-seat shoulder strap of claim 10 wherein said means for maintaining said strap includes locking means attached to said coiled holder.

12. A retractable infant-seat shoulder strap which is attached to an infant-seat including a handle adapted to pivot about an axis, comprising:

(a) a strap having a first end and a second end;

(b) means for retaining said second end of said strap, said means for retaining disposed proximate to said handle and adapted to be attached to said infant-seat on one side thereof and adapted to pivot around said axis; and (c) means for attaching said first end of said strap to a side of said infant-seat that is opposite with respect to said one side thereof.

13. The retractable infant-seat shoulder strap of claim 12 wherein said means for attaching said first end of said strap is adapted to pivotally secure said handle to said infant-seat about said axis.

14. The retractable infant-seat shoulder strap of claim 12 wherein said means for retaining includes a coiled holder having a center thereof and wherein said center is attached to said infant-seat along said axis and wherein said axis is disposed proximate to said center of gravity of said infant-seat.

15. The retractable infant-seat shoulder strap of claim 14 wherein a replacement screw passes through said center thereof and secures said handle and said coiled holder to said infant-seat and wherein said coiled holder and said handle are adapted to pivot around said replacement screw.

16. The retractable infant-seat shoulder strap of claim 12 including a screw-eye that is attached to said infant-seat at said side of said infant-seat opposite said one side on said axis and wherein said axis is disposed proximate to said center of gravity of said infant-seat.

17. The retractable infant-seat shoulder strap of claim 16 wherein said screw-eye secures said handle to said infant-seat and wherein said handle is adapted to pivot around said screw-eye.

* * * * *